US008290354B2

(12) United States Patent
Reusche et al.

(10) Patent No.: US 8,290,354 B2
(45) Date of Patent: Oct. 16, 2012

(54) SYSTEM FOR SECURING A DEICER TO A GUARD

(75) Inventors: Thomas K. Reusche, Elburn, IL (US); Philip E. Chumbley, Aurora, IL (US)

(73) Assignee: Allied Precision Industries, Inc., Elburn, IL (US)

( * ) Notice: Subject to any disclaimer, the term of this patent is extended or adjusted under 35 U.S.C. 154(b) by 440 days.

(21) Appl. No.: 12/634,002

(22) Filed: Dec. 9, 2009

(65) Prior Publication Data

US 2010/0170882 A1 Jul. 8, 2010

Related U.S. Application Data

(60) Provisional application No. 61/142,827, filed on Jan. 6, 2009.

(51) Int. Cl.
*F24H 1/20* (2006.01)

(52) U.S. Cl. ..... 392/441; 219/201; 392/442

(58) Field of Classification Search ..... 219/201, 219/214, 523, 532, 536; 392/441–444, 447, 392/455, 458, 459; 119/73
See application file for complete search history.

(56) References Cited

U.S. PATENT DOCUMENTS

| | | | | |
|---|---|---|---|---|
| 2,665,366 | A * | 1/1954 | Cleveland | 392/444 |
| 6,469,281 | B1 * | 10/2002 | Reusche et al. | 219/438 |
| 7,497,888 | B2 * | 3/2009 | Ashwood et al. | 55/499 |
| 8,041,199 | B2 * | 10/2011 | Reusche et al. | 392/497 |
| 8,121,466 | B2 * | 2/2012 | Reusche et al. | 392/499 |
| 2007/0084168 | A1 * | 4/2007 | Ashwood et al. | 55/486 |

* cited by examiner

*Primary Examiner* — Allan R Wilson
(74) *Attorney, Agent, or Firm* — Joseph M. Butscher; The Small Patent Law Group LLC

(57) ABSTRACT

A deicing system includes a heating element configured to impart heat to water within a water-retaining structure, a guard configured to prevent the heating element from abutting surfaces of the water-retaining structure, and a securing spring that securely fastens the heating element to the guard.

18 Claims, 3 Drawing Sheets

SYSTEM FOR SECURING A DEICER TO A GUARD

RELATED APPLICATIONS

The present application relates to and claims priority from U.S. Provisional Application No. 61/142,827, entitled "Deicer Guard Attachment Spring," filed Jan. 6, 2009, which is hereby incorporated by reference in its entirety.

FIELD OF THE INVENTION

Embodiments of the present invention generally relate to a deicing system, and more particularly, to a system for attaching a wire-frame guard to a stock tank deicer.

BACKGROUND OF THE INVENTION

Electric deicers have been used in livestock water tanks to keep ice from forming during winter months. If deicers were not used, ice would form in the water tanks, thereby preventing livestock from drinking the water within the tanks.

Recently, plastic stock tanks have been used, in place of metal tanks. The use of plastic stock tanks, however, posed a risk in that the heating element of a deicer could directly abut an interior wall of the tank and melt or ignite the plastic.

Accordingly, typical deicing systems secured a wireframe guard to the deicer. The guard ensures that the heating element is disposed away from the plastic walls of the deicer.

FIG. 1 illustrates a front view of a conventional deicing system 10. The deicing system 10 includes a main deicer body 12 attached to a heating element 14, such as a caloric heating rod. The ends of the heating element 14 may enter the main body 12 (although the ends are not shown for the sake of clarity). A strap 16, such as a copper strap, may be soldered to the heating element 14 to provide thermal feedback. As noted above, the heating element 14 is suspended or otherwise positioned away from a base or walls of a tank 15 through a wire-frame guard 18. As shown in FIG. 1, the guard 18 has a base 20 integrally formed with braces 22, which, in turn, integrally connect to a cross-beam 24. The base 20 is substantially wider than the heating element 14, thereby ensuring that the heating element 14 does not abut side walls of a tank 15. Moreover, the braces 22 suspend the heating element 14 above a lower basin wall of the tank 15, thereby preventing the heating element 14 from abutting the lower basin wall. Additionally, the braces 22 may connect to the cross-beam 24 through bent portions 26 that recess the cross-beam 24 below the top portions of the braces 22, thereby providing a physical shield between the heating element 14 and side walls of the tank 15.

A heating element 14 in the form of a caloric rod (calrod) may be bent into various shapes to make it more compact. For a guard 18 to be attached to the calrod, a metallic or other such heat-resistant material clamp is typically used. For example, as shown in FIG. 1, in order to secure the guard 18 to the heating element 14, a bracket 28 and separate and distinct fasteners 30, such as screws, are used. The brackets 28 and fasteners 30 securely fasten the heating element 14 to the cross-beam 24 of the guard wire 18.

FIG. 2 illustrates an isometric view of a conventional clamp assembly. Referring to FIGS. 1 and 2, the bracket 28 is configured to clamp around the heating element 14 and securely fasten to the cross-beam 24 through fasteners, such as screws 30 and nuts 32.

As shown in FIG. 2, in particular, the clamping bracket assembly includes various separate and distinct components.

Each component, including the bracket 28, screws 30, and nuts 32, is typically sealed in a bag. Further, the cost of the components may be relatively high in relation to their purposes. Additionally, the bracket 28 may be awkward and difficult to attach and the small screws 30 and nuts 32 are easy to lose.

SUMMARY OF THE INVENTION

Certain embodiments of the present invention provide a deicing system configured to be positioned within a water-retaining structure. The deicing system is configured to prevent ice from forming within the water-retaining structure.

The deicing system includes a heating element configured to impart heat to water within the water-retaining structure, a guard configured to prevent the heating element from abutting surfaces of the water-retaining structure, and a securing spring that securely fastens the heating element to the guard.

The guard may be a wire-frame guard including a base integrally secured to a cross-beam through braces. The securing spring compressively winds around the cross-beam and the heating element.

The securing spring securely fastens the heating element to the guard without separate and distinct fasteners, such as screws and nuts.

The securing spring may be formed of metal and includes a plurality of evenly-spaced coils. A spacing between a terminal coil of the securing spring and an adjacent intermediate coil may be less than a spacing between two intermediate coils. Internal coil surfaces may be threaded.

The securing spring may wrap around the heating element and a portion of the guard about a central longitudinal axis of the securing spring.

Figure 1:
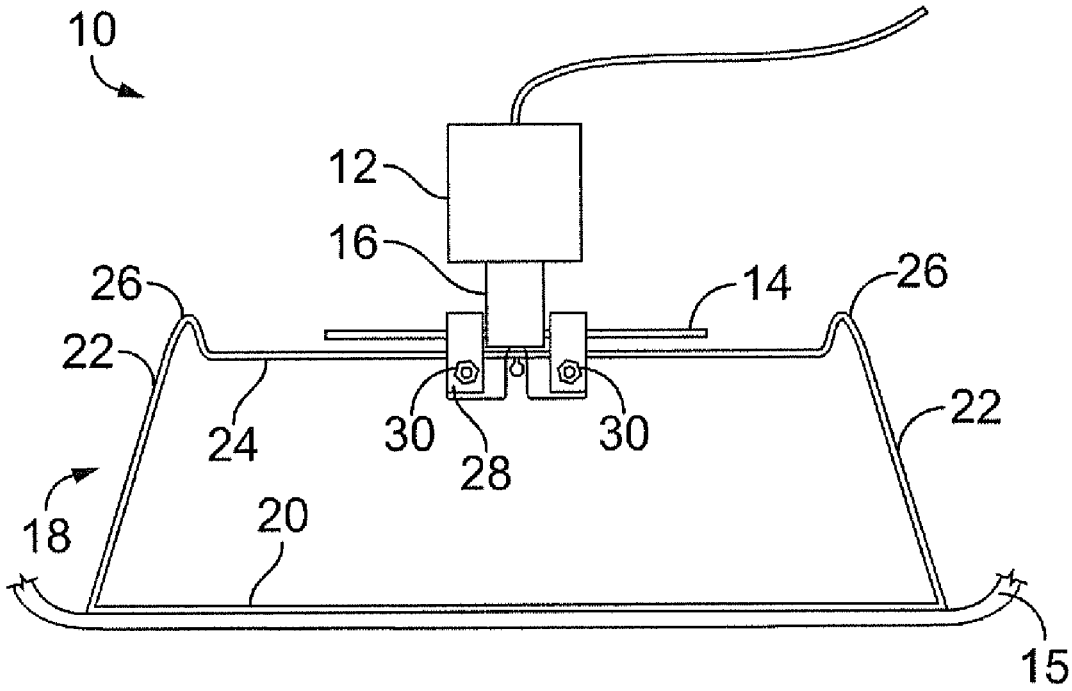
FIG. 1 (Prior Art)
FIG. 1 illustrates a front view of a conventional deicing system.
Figure 2:
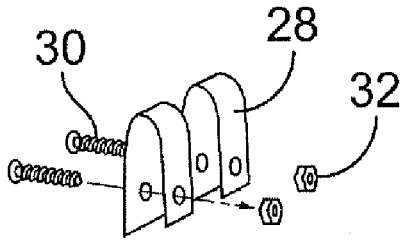
FIG. 2 (Prior Art)
FIG. 2 illustrates an isometric view of a conventional clamp assembly.

The foregoing summary, as well as the following detailed description of certain embodiments of the present invention, will be better understood when read in conjunction with the appended drawings. For the purpose of illustrating the invention, there are shown in the drawings, certain embodiments. It should be understood, however, that the present invention is not limited to the arrangements and instrumentalities shown in the attached drawings.

DETAILED DESCRIPTION OF THE INVENTION

Figure 3A:
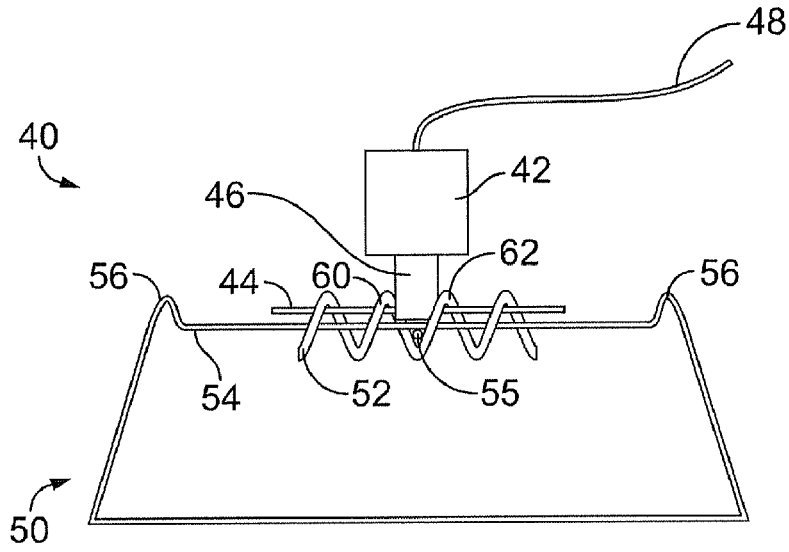
FIG. 3*a* illustrates a front view of a deicing system, according to an embodiment of the present invention.
Figure 3B:
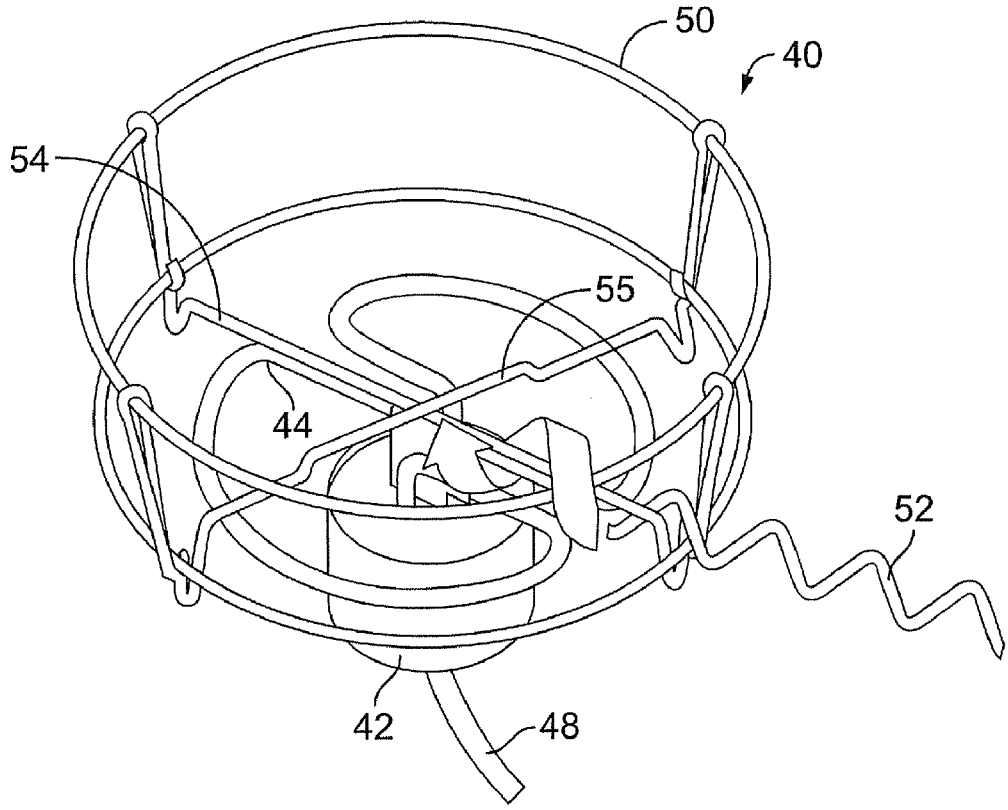
FIG. 3*b* illustrates an isometric bottom view of a deicing system, according to an embodiment of the present invention.

FIG. 3*a* illustrates a front view of a deicing system 40, according to an embodiment of the present invention. FIG. 3*b* illustrates an isometric bottom view of the deicing system 40. Referring to FIGS. 3*a* and 3*b*, the deicing system 40 includes a main deicer body 42 connected to a heating element 44. The main deicer body 42 may include an internal battery compartment, or may be connected to a source of power through an electrical cord 48. An extension beam 46, such as a copper beam, may be soldered to the heating element 44 to provide thermal feedback.

The heating element 44 is securely fastened to a wire-frame guard 50 through a securing spring 52. The securing spring 52 compressively wraps around both the heating element 44 and a cross-beam 54 of the guard 50. As shown in FIG. 3*b*, for example, the guard 50 includes the cross beam 54 and a cross beam 55 that perpendicularly connect to one another in order to provide support to the guard 50.

The coils of the securing spring 52 are sized to securely and compressively wrap around each of the heating element 44 and the cross-beam 54. The intersection of the cross beams 54 and 55 provide a fixed location about which the spring 52 is anchored, as shown in FIG. 3*a*, for example.

The securing spring 52 is formed as a short, stiff spring with a relatively large coil diameter so that it will thread onto the heating element 44 along with the cross-beam 54 in order to securely fasten the heating element 44 to the cross-beam 54. As shown in FIG. 3*b*, the securing spring 52 threads around the heating element 44 and the cross-beam 54 about a central longitudinal axis of the securing spring 52 such that the heating element 44 and the cross-beam 54 are within an internal envelope (a virtual cylinder defined by internal surfaces of the coils) of the securing spring 52. Internal surfaces of the securing spring 52 and external surfaces of the heating element 44 and external surfaces of the cross-beam 54 may be threaded so that the securing spring 52 may threadably and securely engage around the heating element 44 and the cross-beam 54. However, the spring force constant of the securing spring 52 can provide sufficient securing force even without threading.

The securing spring 52 securely fastens the heating element 44 to the guard 50, while also centering the heating element 44 over the guard 50. The securing spring 52 may be formed to a length such that terminal ends abut into the brace shields 56 at the upper ends of the guard 50, thereby providing additional insurance that the heating element 44 remains properly centered.

Notably, the securing spring 52 is not clamped around the heating element 44 with separate and distinct fasteners. The securing spring 52 stays in place because the forces that would be needed to "unthread" the securing spring 52 from the heating element 44 and the cross-beam 54 would need to act along the spring in a circular motion. However, localized water movement of this type is generally not found in a normal pond or stock tank.

The deicing system 40 is configured to be positioned within a stock tank or a pond in order to prevent ice from forming therein. The securing spring 52 secures the heating element 44 to the guard 50, which, in turn, prevents the heating element 44 from directly abutting internal surfaces of the stock tank or pond.

Figure 4:
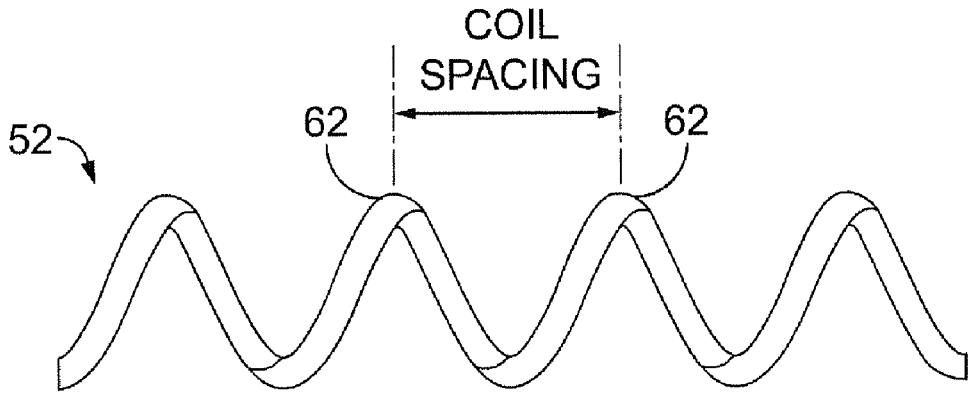
FIG. 4 illustrates a front view of a securing spring, according to an embodiment of the present invention.

FIG. 4 illustrates a front view of the securing spring 52, according to an embodiment of the present invention. The spacing between coils may be greater than the width of the extension beam 46, which may be a copper strap that provides thermal feedback between the heating element 44 and electronics within the main body 42. Such coil spacing allows the securing spring 52 to be threaded around the heating element 44 and the cross-beam 54 while accommodating the extension beam 46. As shown in FIG. 3*a*, for example, adjacent coils 60 and 62 fit around the extension beam 46. Accordingly, the extension beam 46 does not hinder proper threading of the securing spring 52. At the same time, however, the securing spring 52 is sized so that the coil spacing is not too large to allow the heating element 44 to slide with respect to the guard 50. that provides thermal feedback between the heating element 44 and electronics within the main body 42. Such coil spacing allows the securing spring 52 to be threaded around the heating element 44 and the cross-beam 54 while accommodating the extension beam 46. As shown in FIG. 3, for example, adjacent coils 60 and 62 fit around the extension beam 46. Accordingly, the extension beam 46 does not hinder proper threading of the securing spring 52. At the same time, however, the securing spring 52 is sized so that the coil spacing is not too large to allow the heating element 44 to slide with respect to the guard 50.

Figure 5:
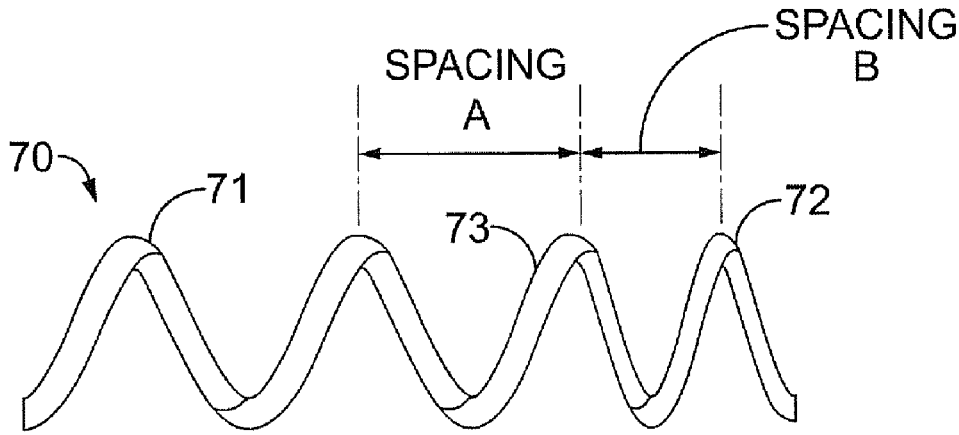
FIG. 5 illustrates a front view of a securing spring, according to an embodiment of the present invention.

FIG. 5 illustrates a front view of a securing spring 70, according to an embodiment of the present invention. The spacing between middle coils 71 and 72 is a distance A. However, the distance between the terminal coil 72 and an adjacent coil 73 is a distance B, which is less than distance A. The distance B may not be great enough to accommodate the extension beam 46, shown in FIG. 3, as explained above. However, because the terminal coil 72 is at the end of the securing spring 70, the terminal coil 72 does not encounter the extension beam 46 during a threading process.

The smaller coil spacing B prevents the terminal coil 72 from accidentally being rotated or threaded to a point where it would disengage from the heating element. Accordingly, once the securing spring 70 is threaded in place as far as it can go, the leading coil on the opposite side of the extension beam 46 may be deformed slightly through compression, thereby effectively locking the securing spring 70 in place.

Alternatively, instead of the securing spring being stiff, the securing spring may be elastic and the coil spacing may be less than the width of the extension beam 46/thermal feedback strap. In this case, the elasticity of the coils allows the securing spring to be extended slightly in order to thread it past the extension beam 46. The normal tendency of the securing spring to return to its non-extended length causes it to tighten around the feedback strap and hold itself in place, as well as securely fastening the heating element to the guard.

Thus, embodiments of the present invention provide a securing assembly devoid of separate and distinct fasteners, such as screws and nuts, that are susceptible to being lost. Moreover, the securing spring is easy and intuitive to assemble in that one merely threads it over the heating element and cross-beam of the guard (as opposed to the assembly process required for a conventional clamping assembly). Further, embodiments of the present invention provide a securing device, that is, the securing spring, that is less costly to manufacture than the bracket and fasteners of a conventional clamping assembly.

In general, embodiments of the present invention provide a simple, low-cost system and method for attaching a wire-frame guard to a heating element of a deicing system.

While various spatial terms, such as upper, bottom, lower, mid, lateral, horizontal, vertical, and the like may be used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

The invention claimed is:

1. A deicing system configured to be positioned within a water-retaining structure, wherein the deicing system is configured to prevent ice from forming within the water-retaining structure, the deicing system comprising:

a heating element configured to impart heat to water within the water-retaining structure;

a guard configured to prevent said heating element from abutting surfaces of the water-retaining structure; and a securing spring that securely fastens said heating element to said guard, wherein said securing spring comprises internal coil surfaces that are threaded.

2. The deicing system of claim 1, wherein said guard is a wire-frame guard comprising a base integrally secured to a cross-beam through braces, wherein said securing spring compressively winds around said cross-beam and said heating element.

3. The deicing system of claim 1, wherein said securing spring securely fastens said heating element to said guard without separate and distinct fasteners.

4. The deicing system of claim 1, wherein said securing spring comprises a plurality of evenly-spaced coils.

5. The deicing system of claim 1, wherein said securing spring comprises intermediate coils and a terminal coil, wherein a spacing between a terminal coil and an adjacent intermediate coil is less than a spacing between two intermediate coils.

6. The deicing system of claim 1, wherein said securing spring wraps around said heating element and a portion of said guard about a central longitudinal axis of said securing spring.

7. The deicing system of claim 1, wherein said heating element comprises a caloric rod.

8. A deicing system configured to be positioned within a water-retaining structure, wherein the deicing system is configured to prevent ice from forming within the water-retaining structure, the deicing system comprising:

a heating element configured to impart heat to water within the water-retaining structure;

a wire-frame guard configured to prevent said heating element from abutting a surface of the water-retaining structure, wherein said wire-frame guard comprises a base integrally secured to a cross-beam through braces; and a securing spring that securely fastens said heating element to said wire-frame guard, wherein said securing spring comprises internal coil surfaces that are threaded, wherein said securing spring wraps around said heating element and a portion of said guard about a central longitudinal axis of said securing spring, and wherein said securing spring compressively winds around said cross-beam and said heating element.

9. The deicing system of claim 8, wherein said securing spring securely fastens said heating element to said guard without separate and distinct fasteners.

10. The deicing system of claim 8, wherein said securing spring comprises a plurality of evenly-spaced coils.

11. The deicing system of claim 8, wherein said securing spring comprises intermediate coils and a terminal coil, wherein a spacing between a terminal coil and an adjacent intermediate coil is less than a spacing between two intermediate coils.

12. The deicing system of claim 8, wherein said heating element comprises a caloric rod.

13. A deicing system, comprising:

a heating element comprising a caloric rod, wherein said caloric rod is configured to impart heat to water within a water-retaining structure;

a wire-frame guard configured to prevent said heating element from abutting a surface of the water-retaining structure, wherein said wire-frame guard comprises a base integrally secured to a cross-beam through braces, wherein said braces are configured to suspend said heating element above a basin of the water-retaining structure, and wherein said base, said cross-beam and said braces are configured to prevent said heating element from abutting walls of the water-retaining structure; and a securing spring that securely fastens said heating element to said wire-frame guard, wherein said securing spring comprises internal coil surfaces that are threaded, wherein said securing spring wraps around said heating element and a portion of said guard about a central longitudinal axis of said securing spring, wherein said securing spring compressively winds around said cross-beam and said heating element, and wherein said securing spring is devoid of separate and distinct fastener such that said securing spring securely fastens the heating element to the wire-frame guard without separate and distinct fasteners.

14. The deicing system of claim 13, wherein said securing spring comprises a plurality of evenly-spaced coils.

15. The deicing system of claim 13, wherein said securing spring comprises intermediate coils and a terminal coil, wherein a spacing between a terminal coil and an adjacent intermediate coil is less than a spacing between two intermediate coils.

16. A deicing system configured to be positioned within a water-retaining structure, wherein the deicing system is configured to prevent ice from forming within the water-retaining structure, the deicing system comprising:

a heating element configured to impart heat to water within the water-retaining structure;

a guard configured to prevent said heating element from abutting surfaces of the water-retaining structure; and a securing spring that securely fastens said heating element to said guard, wherein said securing spring comprises intermediate coils and a terminal coil, wherein a spacing between a terminal coil and an adjacent intermediate coil is less than a spacing between two intermediate coils.

17. A deicing system configured to be positioned within a water-retaining structure, wherein the deicing system is configured to prevent ice from forming within the water-retaining structure, the deicing system comprising:

a heating element configured to impart heat to water within the water-retaining structure;

a wire-frame guard configured to prevent said heating element from abutting a surface of the water-retaining structure, wherein said wire-frame guard comprises a base integrally secured to a cross-beam through braces; and a securing spring that securely fastens said heating element to said wire-frame guard, wherein said securing spring comprises intermediate coils and a terminal coil, wherein a spacing between a terminal coil and an adjacent intermediate coil is less than a spacing between two intermediate coils, wherein said securing spring wraps around said heating element and a portion of said guard about a central longitudinal axis of said securing spring, and wherein said securing spring compressively winds around said cross-beam and said heating element.

18. A deicing system, comprising:

a heating element comprising a caloric rod, wherein said caloric rod is configured to impart heat to water within a water-retaining structure;

a wire-frame guard configured to prevent said heating element from abutting a surface of the water-retaining structure, wherein said wire-frame guard comprises a base integrally secured to a cross-beam through braces, wherein said braces are configured to suspend said heating element above a basin of the water-retaining structure, and wherein said base, said cross-beam and said braces are configured to prevent said heating element from abutting walls of the water-retaining structure; and a securing spring that securely fastens said heating element to said wire-frame guard, wherein said securing spring comprises intermediate coils and a terminal coil, wherein a spacing between a terminal coil and an adjacent intermediate coil is less than a spacing between two intermediate coils, wherein said securing spring wraps around said heating element and a portion of said guard about a central longitudinal axis of said securing spring, wherein said securing spring compressively winds around said cross-beam and said heating element, and wherein said securing spring is devoid of separate and distinct fastener such that said securing spring securely fastens the heating element to the wire-frame guard without separate and distinct fasteners.

* * * * *